US008875933B2

(12) United States Patent
Griffiths et al.

(10) Patent No.: US 8,875,933 B2
(45) Date of Patent: Nov. 4, 2014

(54) DRAINABLE CONTAINER SYSTEM

(75) Inventors: Leonard Barry Griffiths, Fenton, MI (US); Roxann M. Bittner, Rochester Hills, MI (US); David R. Staley, Flushing, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 495 days.

(21) Appl. No.: 13/238,018

(22) Filed: Sep. 21, 2011

(65) Prior Publication Data

US 2013/0068778 A1 Mar. 21, 2013

(51) Int. Cl.

| | |
|---|---|
| ***B65D 6/40*** | (2006.01) |
| ***B65D 53/02*** | (2006.01) |
| ***F01M 11/04*** | (2006.01) |
| *B65D 1/34* | (2006.01) |

(52) U.S. Cl.

CPC ... *F01M 11/0408* (2013.01); *F01M 2011/0416* (2013.01)

USPC ..... 220/573; 220/571; 220/361; 220/562; 220/601

(58) Field of Classification Search

CPC ..... B65D 5/726; B65D 39/04; B65D 39/088; B65D 39/08; B65D 39/16

USPC ..... 220/571, 562, 361, 288, 601, 573

See application file for complete search history.

(56) References Cited

U.S. PATENT DOCUMENTS

| | | | | |
|---|---|---|---|---|
| 4,205,758 | A * | 6/1980 | Johnson | 220/235 |
| 4,717,119 | A * | 1/1988 | Trin | 251/144 |
| 4,938,314 | A * | 7/1990 | Sitzler et al. | 184/1.5 |
| 5,368,181 | A * | 11/1994 | Myers | 220/303 |
| 6,905,040 | B2 * | 6/2005 | Hilger et al. | 220/301 |
| 8,561,761 | B2 * | 10/2013 | Jessberger et al. | 184/106 |
| 2001/0047996 | A1 * | 12/2001 | Weingaertner | 220/571 |
| 2007/0170390 | A1 * | 7/2007 | Jessberger | 251/215 |
| 2008/0135340 | A1 * | 6/2008 | Schlicker et al. | 184/106 |
| 2009/0283525 | A1 * | 11/2009 | Martinez et al. | 220/235 |
| 2010/0000998 | A1 | 1/2010 | Schütz | |
| 2010/0006376 | A1 | 1/2010 | Jessberger et al. | |
| 2011/0011865 | A1 * | 1/2011 | Cook et al. | 220/288 |
| 2011/0284539 | A1 * | 11/2011 | Stevenson | 220/233 |
| 2012/0097679 | A1 * | 4/2012 | Kyung Kim | 220/345.1 |

FOREIGN PATENT DOCUMENTS

WO 2007017852 A1 2/2007

* cited by examiner

*Primary Examiner* — Mickey Yu

*Assistant Examiner* — Niki Eloshway

(74) *Attorney, Agent, or Firm* — Quinn Law Group, PLLC

(57) ABSTRACT

A drainable container system for a vehicle includes a container having an exterior surface and defining an interior cavity configured for storing a fluid, and a drain hole configured for draining the fluid from the cavity. The hole has a central longitudinal axis that is substantially perpendicular to the surface. The system includes a drain plug, wherein the plug is insertable into the hole along the axis into a locked position so that the fluid does not drain, and removable from the hole along the axis when disposed in an unlocked position so that the fluid drains. The system includes a locking element configured for preventing rotation of the plug within the hole about the axis when the plug is disposed in the locked position, wherein the element is formed from a metal that is substantially elastic at a temperature of from about −40° C. to about 10° C.

9 Claims, 6 Drawing Sheets

DRAINABLE CONTAINER SYSTEM

TECHNICAL FIELD

The present disclosure generally relates to drainable container systems for vehicles.

BACKGROUND

Vehicles often include drainable containers that are configured for storing a fluid. For example, drainable containers such as oil pans and other fluid reservoirs may store engine oil, differential gear lubricants, transmission fluid, and the like. Such fluids typically become contaminated and/or depleted during operation of the vehicle, and must therefore be refreshed and/or replenished periodically. Accordingly, such drainable containers often include a drain hole for draining the fluid from the drainable container during fluid change-out operations. The drain hole may be plugged by a removable drain plug so that fluid does not drain from the drainable container during operation of the vehicle.

A vehicle may require many fluid change-out operations over an operating life of the vehicle, and such fluid change-out operations may occur under a variety of temperature conditions, e.g., in cold weather.

SUMMARY

A drainable container system for a vehicle includes a container having an exterior surface and defining an interior cavity configured for storing a fluid. The container also defines a drain hole configured for draining the fluid from the interior cavity, and the drain hole has a central longitudinal axis that is substantially perpendicular to the exterior surface. In addition, the drainable container system includes a drain plug, wherein the drain plug is insertable into the drain hole along the central longitudinal axis into a locked position so that fluid does not drain from the interior cavity, and wherein the drain plug is removable from the drain hole along the central longitudinal axis when disposed in an unlocked position so that the fluid drains from the interior cavity. Further, the drainable container system includes a locking element configured for preventing rotation of the drain plug within the drain hole about the central longitudinal axis when the drain plug is disposed in the locked position. The locking element is formed from a metal that is substantially elastic at a temperature of from about −40° C. to about 10° C.

In one embodiment, the locking element is attached to the drain plug.

In another embodiment, the drain plug is transitionable from the locked position to the unlocked position in response to a force applied to the locking element along the central longitudinal axis as the drain plug rotates about the central longitudinal axis.

The above features and other features and advantages of the present disclosure are readily apparent from the following detailed description of the best modes for carrying out the disclosure when taken in connection with the accompanying drawings.

DETAILED DESCRIPTION

Figure 1A:
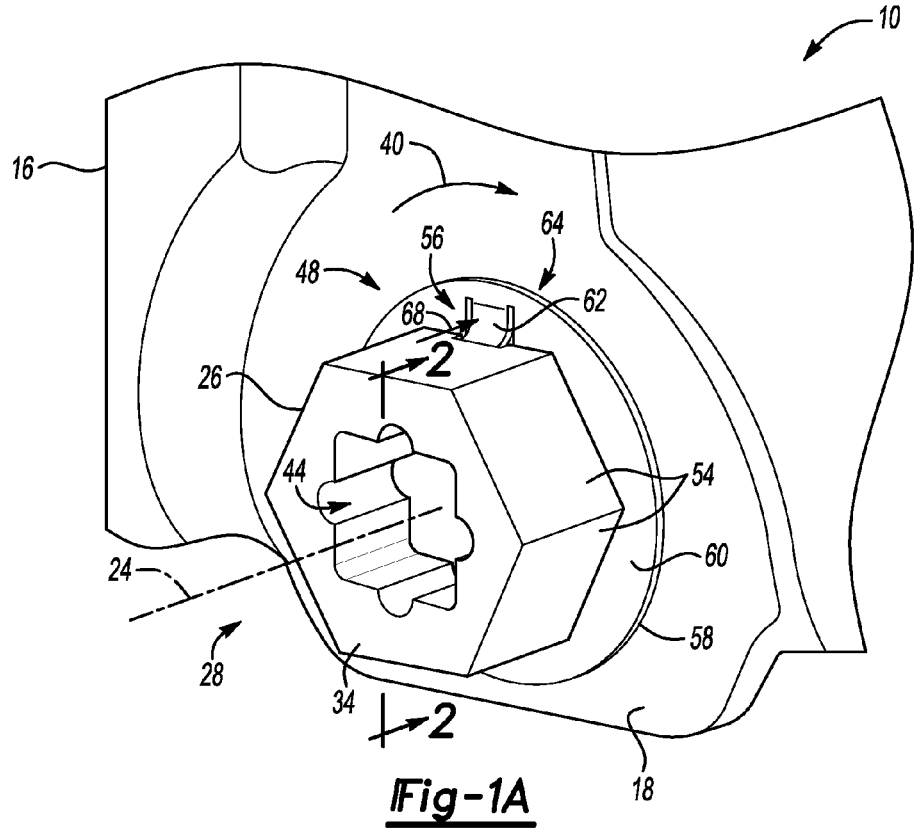
FIG. 1A is a schematic perspective fragmentary illustration of a drainable container system for a vehicle including a drain plug disposed in a locked position.

Referring to the Figures, wherein like reference numerals refer to like elements, a drainable container system 10 for a vehicle 12 (FIG. 2) is shown generally in FIG. 1A. The drainable container system 10 may be useful for storing fluid 14 (FIG. 2) necessary for operation of the vehicle 12. More specifically, the drainable container system 10 may be useful for fluid change-out operations performed at cold temperatures, e.g., at a temperature of from about −40° C. to about 10° C., that are required for maintenance of the vehicle 12. Therefore, the drainable container system 10 may be useful for automotive applications such as, for example, oil pans, differential gear lubricant housings, and other fluid reservoirs for vehicles 12. However, the drainable container system 10 may also be useful for fluid reservoirs for non-automotive applications including, but not limited to, recreational vehicles, agricultural vehicles, and lawnmowers.

Referring again to FIGS. 1A and 2, the drainable container system 10 includes a container 16 having an exterior surface 18 and defining an interior cavity 20 (FIG. 2) configured for storing the fluid 14 (FIG. 2). The container 16 may be any fluid reservoir, and the interior cavity 20 may store any fluid 14. For example, the container 16 may be an oil pan of an automotive vehicle 12 and may be configured for storing engine oil. Alternatively, the container 16 may be a differential gear housing of an automotive vehicle 12 and may be configured for storing gear lubricant. Further, the container 16 may be formed from a non-metallic material, e.g., plastic.

Figure 2:
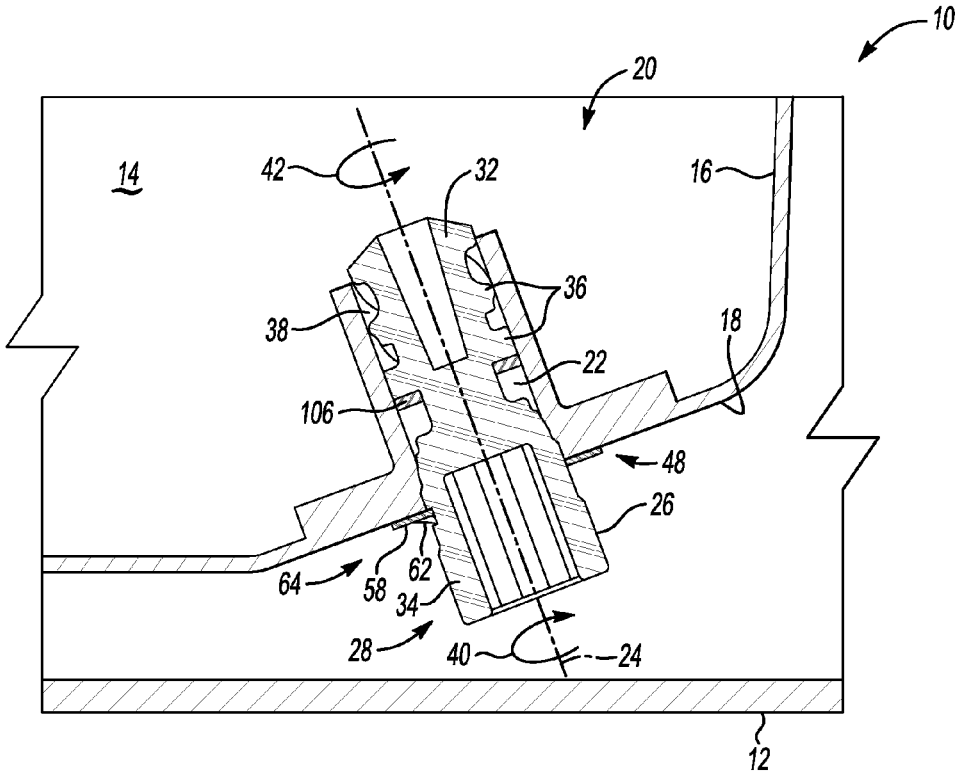
FIG. 2 is a schematic cross-sectional fragmentary illustration of the drainable container system of FIG. 1A taken along section lines 2-2.

With continued reference to FIG. 2, the fluid 14 may be disposed within the interior cavity 20. That is, the container 16 may contain and store the fluid 14 for use during operation of the vehicle 12. By way of non-limiting examples, the fluid 14 may be engine oil, transmission fluid, gear lubricant, water, or any liquid suitable for operation of the vehicle 12. The vehicle 12 may consume and/or contaminate the fluid 14 during vehicle operation. For example, for the variation including engine oil, the fluid 14 may be recirculated throughout an engine (not shown) of the vehicle 12 and may become contaminated with sludge and deposits, and/or may thermally degrade during operation of the vehicle 12. As such, the fluid 14 may require periodic draining from the interior cavity 20 during fluid change-out operations.

Figure 3A:
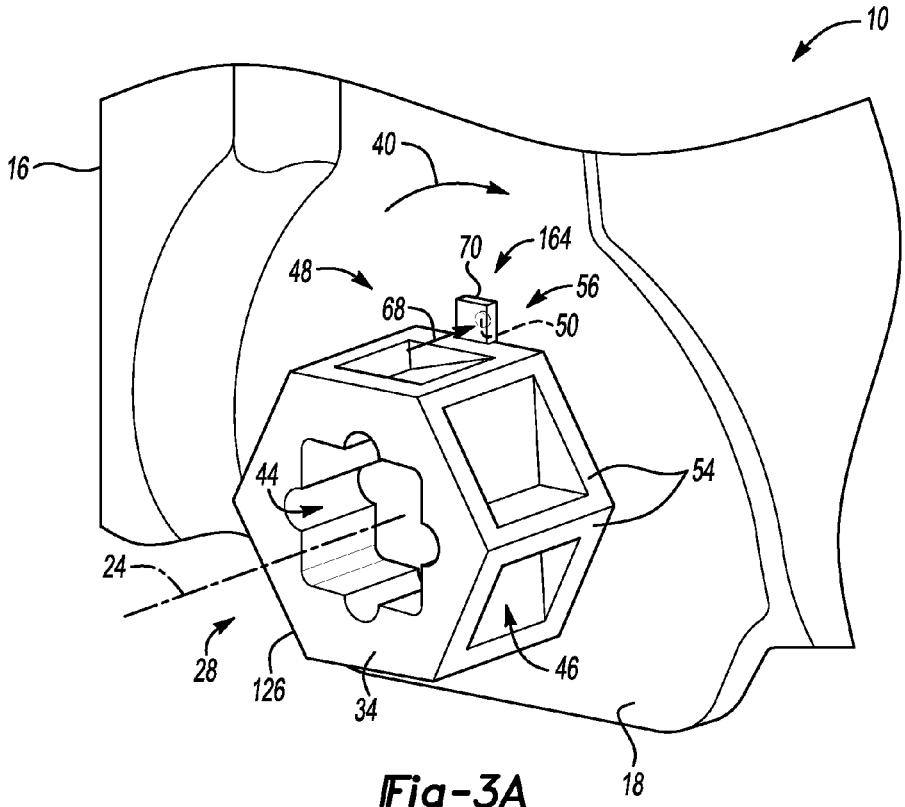
FIG. 3A is a schematic perspective fragmentary illustration of another embodiment of the drainable container system of FIGS. 1A and 1B, wherein the drain plug is disposed in the locked position.
Figure 3B:
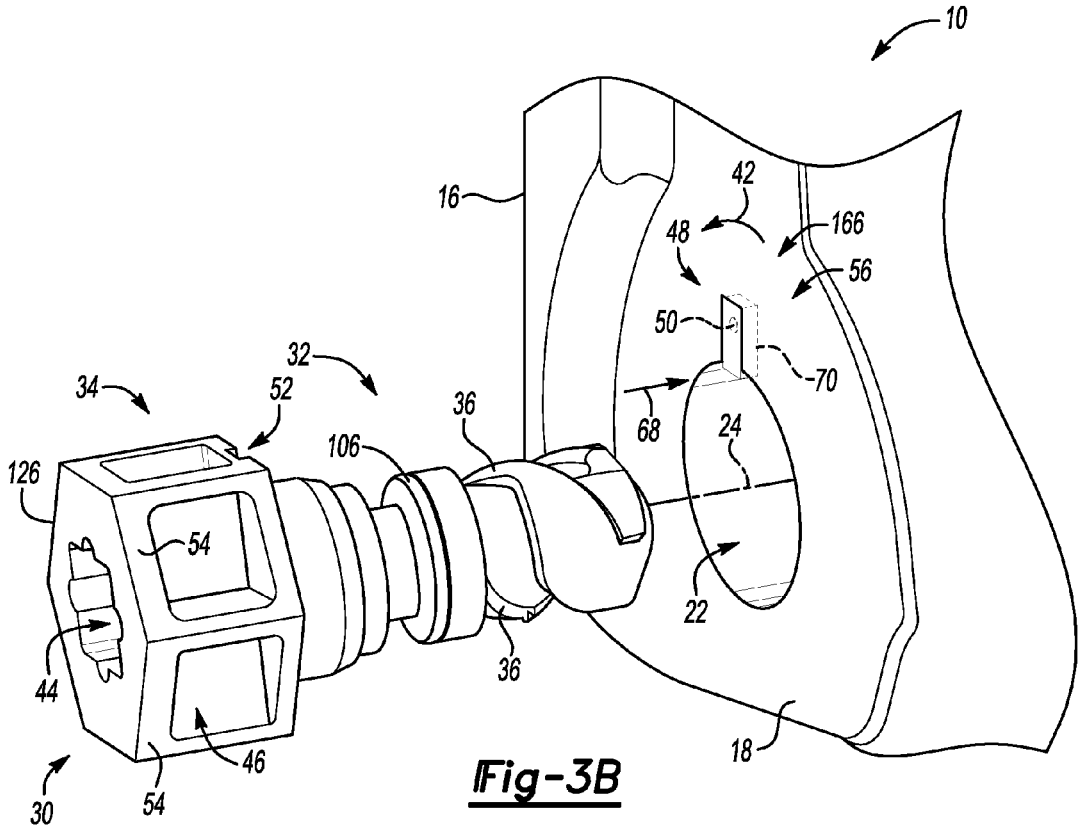
FIG. 3B is a schematic perspective fragmentary illustration of the drainable container system of FIG. 3A, wherein the drain plug is disposed in the unlocked position.

Therefore, as best shown in FIGS. 2 and 3B, the container 16 also defines a drain hole 22 configured for draining the fluid 14 (FIG. 2) from the interior cavity 20 (FIG. 2). The drain hole 22 has a central longitudinal axis 24 that is substantially perpendicular to the exterior surface 18.

Referring again to FIGS. 1A and 2, the drainable container system 10 also includes a drain plug 26. The drain plug 26 may be configured for plugging the drain hole 22 (FIG. 2). That is, the drain plug 26 is insertable into the drain hole 22 along the central longitudinal axis 24 into a locked position (shown generally at 28 in FIG. 1A) so that the fluid 14 (FIG. 2) does not drain from the interior cavity 20 (FIG. 2). Additionally, the drain plug 26 is removable from the drain hole 22 along the central longitudinal axis 24 when disposed in an unlocked position (shown generally at 30 in FIG. 1B) so that the fluid 14 drains from the interior cavity 20. That is, the drain plug 26 may be inserted into the drain hole 22 in the locked position 28 (FIG. 1A) during operation of the vehicle 12 (FIG. 2) so as to plug or seal off the drain hole 22 so that the fluid 14 may be stored within the interior cavity 20 of the container 16. In addition, as described with reference to FIG. 3B, the drain plug 26 may be removed from the drain hole 22 in the unlocked position 30 (FIG. 1B) during fluid change-out operations so that the fluid 14 may drain from the interior cavity 20 of the container 16.

Although the drain plug 26 may have any shape, as best shown in FIGS. 2 and 3B, the drain plug 26 may include an elongated body portion 32 and a head 34. The elongated body portion 32 may include a plurality of threads 36 configured for threadably mating with a helical groove 38 (FIG. 2) defined by the container 16. That is, the drain plug 26 may be inserted into the drain hole 22 along the central longitudinal axis 24 by rotating the drain plug 26 in a first direction (denoted generally by arrow 40 in FIGS. 1A and 2), e.g., a clockwise direction, to thereby dispose and tighten the drain plug 26 within the drain hole 22. Similarly, although set forth in more detail below, the drain plug 26 may be removed from the drain hole 22 along the central longitudinal axis 24 by rotating the drain plug 26 in a second direction (denoted generally by arrow 42 in FIGS. 1B and 2) that is opposite the first direction 40, e.g., a counterclockwise direction.

Referring again to FIG. 1A, the head 34 of the drain plug 26 may include one or more drive features to enable insertion and removal of the drain plug 26 from the drain hole 22 (FIG. 3B) during fluid change-out operations. For example, the head 34 may be configured as a hexagon for coupling with a socket wrench (not shown) or other insertion and/or removal tool. In another example, the head 34 may define a void 44 therein having a shape that is complementary to an insertion and/or removal tool (not shown). It is to be appreciated that, although shown as having a hexagon shape and defining the void 44 having a generally star shape, the head 34 may have any shape, size, or configuration, and may define the void 44 having any shape, size, or configuration suitable for a desired application of the drainable container system 10. Further, as best shown in FIGS. 3A-6B, the head 34 of the drain plug 126 may define one or more apertures 46 therein. Such apertures 46 may be configured for connecting the drain plug 126 to other components of the drainable container system 10, as set forth in more detail below.

Figure 1B:
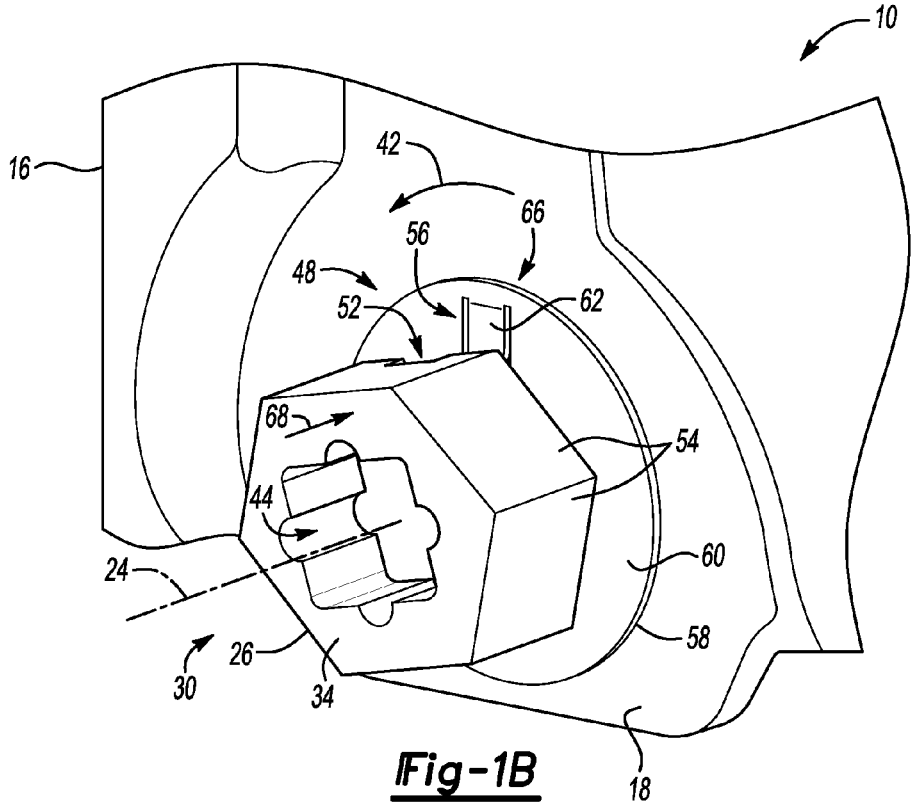
FIG. 1B is a schematic perspective fragmentary illustration of the drainable container system of FIG. 1A, wherein the drain plug is disposed in an unlocked position.

With continued reference to FIGS. 1A and 1B, the drainable container system 10 further includes a locking element 48 configured for preventing rotation of the drain plug 26 within the drain hole 22 (FIG. 3B) about the central longitudinal axis 24 when the drain plug 26 is disposed in the locked position 28 (FIG. 1A). That is, the locking element 48 may ensure that the drain plug 26 remains tightly fitted and sealed to the container 16 within the drain hole 22 so that fluid 14 (FIG. 2) may not drain from the interior cavity 20 (FIG. 2) at unintended intervals, e.g., during operation of the vehicle 12 (FIG. 2). The locking element 48 may therefore lock the drain plug 26 to the container 16, prevent rotation of the drain plug 26 within the drain hole 22, and minimize loosening or unintended removal of the drain plug 26 after installation, e.g., during operation of the vehicle 12.

The locking element 48 is formed from a metal that is substantially elastic at a temperature of from about −40° C. to about 10° C. That is, the metal may be ductile or elastic and may not be brittle at the aforementioned temperature range. As used herein, the terminology "brittle" refers to a metal that, when subjected to stress, breaks or fractures without deformation or strain. That is, a brittle metal absorbs relatively little energy prior to fracture as compared to a non-brittle or ductile metal that deforms before eventually breaking. Rather, the locking element 48 is formed from a metal that is substantially elastic at the aforementioned temperature range, and is configured to maintain and/or return to an original shape and functionality. As used herein, the terminology "substantially elastic" refers to a metal that does not permanently deform when a given stress is applied to the metal. As such, the locking element 48 may be useful for locking and unlocking the drain plug 26 to and from the drain hole 22 (FIG. 3B) during fluid change-out operations performed in cold weather conditions, e.g., at a temperature of from about −40° C. to about 10° C., since the locking element 48 is substantially elastic and does not fail, e.g., break or fracture, under such conditions. In addition, the locking element 48 may be formed from a metal suitable for repeated tensile and/or torsional stress so that the locking element 48 may suitably perform even after multiple fluid change-out operations over the operating life of the vehicle 12 (FIG. 2). That is, the locking element 48 and drain plug 26 may be cycled, e.g., locked and unlocked, multiple times without fracturing due to stress. By way of non-limiting examples, the locking element 48 may be formed from steel or ductile iron.

Referring now to FIGS. 1A, 1B, 3A, and 3B, in one embodiment, the locking element 48 may be attached to the container 16. For example, for the embodiment shown in FIGS. 1A and 1B, the locking element 48 may be fixedly adhered or welded to the exterior surface 18 of the container 16. Alternatively, for the embodiment shown in FIGS. 3A and 3B, the locking element 48 may be mechanically coupled to the container 16, e.g., attached to the container 16 by a resilient member 50 (FIG. 3A).

With continued reference to FIGS. 1A, 1B, 3A, and 3B, the drain plug 26 may be configured for mechanically interlocking with the locking element 48, and may define a recess 52 (FIGS. 1B and 3B) therein. That is, as best shown in FIGS. 1B and 3B, the recess 52 may be configured as a cut-out or slot, and may be defined by the head 34 of the drain plug 26. For example, the recess 52 may be defined by one or more sides 54 of the head 34 of the drain plug 26. Further, although not shown, the drain plug 26 may define a plurality of recesses 52 therein. For example, two opposite or adjacent sides 54 of the head 34 may each define one recess 52 therein.

Referring again to FIGS. 1A, 1B, 3A, and 3B, in one embodiment, the locking element 48 includes a depressible tab 56 configured for extending into the recess 52 so that the locking element 48 mechanically interlocks with the drain plug 26 and thereby prevents rotation of the drain plug 26 within the drain hole 22 (FIG. 3B) about the central longitudinal axis 24 when the drain plug 26 is disposed in the locked position 28 (FIGS. 1A and 3A).

For example, as best shown in FIGS. 1A and 1B, the locking element 48 may be configured as a disc 58 having an outer surface 60, and may be coaxial with the central longitudinal axis 24. Further, the depressible tab 56 may be configured as a resilient clip 62. That is, the resilient clip 62 may be formed from the metal of the locking element 48 and may resiliently transition between a first position (shown generally at 64 in FIG. 1A) and a second position (shown generally at 66 in FIG. 1B). More specifically, as shown in FIG. 1A, the resilient clip 62 may be transitionable between the first position 64 in which the resilient clip 62 protrudes from the outer surface 60 into the recess 52 so that the drain plug 26 is disposed in the locked position 28 and is not rotatable about the central longitudinal axis 24, and, as shown in FIG. 1B, the second position 66 in which the resilient clip 62 is substantially flush with the outer surface 60 and does not protrude into the recess 52 so that the drain plug 26 is disposed in the unlocked position 30 and is rotatable about the central longitudinal axis 24.

In particular, the resilient clip 62 may be transitionable from the first position 64 (FIG. 1A) to the second position 62 (FIG. 1B) in response to a force (denoted generally by arrow 68 in FIGS. 1A and 1B) applied to the resilient clip 62 along the central longitudinal axis 24. That is, during a fluid change-out operation, the drain plug 26 may be initially disposed in the locked position 28 (FIG. 1A). To dispose the drain plug 26 in the unlocked position 30 (FIG. 1B), an operator or machine may apply the force 68 against the resilient clip 62 to depress the resilient clip 62 so that the resilient clip 62 no longer extends into the recess 52, but is instead substantially flush to the outer surface 60 of the disc 58. Concurrent to applying the force 68, the operator or machine may rotate the drain plug 26 in the second direction 42 (FIG. 1B), e.g., counterclockwise, so as to disengage the plurality of threads 36 (FIG. 2) from the helical groove 38 (FIG. 2) and thereby dispose the drain plug 26 in the unlocked position 30 (FIG. 1B) for removal of the drain plug 26 from the drain hole 22 along the central longitudinal axis 24. Consequently, fluid 14 (FIG. 2) may drain from the interior cavity 20 (FIG. 2) of the container 16.

Similarly, to re-install the drain plug 26 upon completion of the fluid change-out operation and dispose the drain plug 26 in the locked position 28 (FIG. 1A), the operator or machine may insert the drain plug 26 along the central longitudinal axis 24 and rotate the drain plug 26 in the first direction 40 (FIG. 1A). As the plurality of threads 36 (FIG. 2) engage with and mate to the helical groove 38 (FIG. 2), and a distance between the locking element 48 and the drain plug 26 diminishes, the operator or machine may apply the force 68 against the resilient clip 62 along the central longitudinal axis 24 to depress the resilient clip 62 while concurrently aligning the resilient clip 62 with the recess 52 (FIG. 1B). When the resilient clip 62 is aligned with the recess 52, the operator or machine may release the force 68 against the resilient clip 62 so that the resilient clip 62 may pop up or extend into the recess 52 and thereby mechanically interlock the drain plug 26 with the locking element 48. As such, the resilient clip 62 may protrude from the outer surface 60 into the recess 52 so that the drain plug 26 is disposed in the locked position 28 (FIG. 1A) and is not rotatable about the central longitudinal axis 24. Consequently, fluid 14 (FIG. 2) may not drain from the interior cavity 20 (FIG. 2) of the container 16.

Referring now to FIGS. 3A and 3B, in another embodiment, the depressible tab 56 may be configured as an elongated bar 70 that is actuatable by the resilient member 50. For example, the resilient member 50 may be configured as a coil spring and arranged to contact the elongated bar 70 so as to extend the elongated bar 70 outwardly from the exterior surface 18 of the container 16. That is, upon application of the force 68 to the elongated bar 70, the resilient member 50 may compress and store potential energy until the force 68 is released. As the force 68 is released from the elongated bar 70, the resilient member 50 may then contact the elongated bar 70 and push the elongated bar 70 outward from the exterior surface 18 of the container 16. As best shown in FIG. 3B, the elongated bar 70 may be disposed adjacent to the drain hole 22.

With continued reference to FIGS. 3A and 3B, the elongated bar 70 may be transitionable between a first position 164 (FIG. 3A) in which the elongated bar 70 protrudes from the container 16 adjacent to the drain hole 22 and into the recess 52 (FIG. 3B) so that the drain plug 126 is disposed in the locked position 28 (FIG. 3A) and is not rotatable about the central longitudinal axis 24, and a second position 166 (FIG. 3B) in which the elongated bar 70 is substantially flush with the exterior surface 18 and does not protrude into the recess 52 so that the drain plug 126 is disposed in the unlocked position 30 (FIG. 3B) and is rotatable about the central longitudinal axis 24.

More specifically, the elongated bar 70 may be transitionable from the first position 164 (FIG. 3A) to the second position 166 (FIG. 3B) in response to the force (denoted generally by arrow 68 in FIGS. 3A and 3B) applied to the elongated bar 70 and the resilient member 50 along the central longitudinal axis 24. That is, during a fluid change-out operation, the drain plug 126 may be initially disposed in the locked position 28 (FIG. 3A). To dispose the drain plug 126 in the unlocked position 30 (FIG. 3B), an operator or machine may apply the force 68 against the elongated bar 70 and resilient member 50 to depress the elongated bar 70 and resilient member 50 so that the elongated bar 70 no longer extends into the recess 52 (FIG. 3B), but is instead substantially flush to the exterior surface 18 of the container 16. Concurrent to applying the force 68, the operator or machine may rotate the drain plug 126 in the second direction 42 (FIG. 3B), e.g., counterclockwise, so as to disengage the plurality of threads 36 (FIG. 2) from the helical groove 38 (FIG. 2) and thereby dispose the drain plug 126 in the unlocked position 30 (FIG. 3B) for removal of the drain plug 126 from the drain hole 22 along the central longitudinal axis 24. Consequently, fluid 14 (FIG. 2) may drain from the interior cavity 20 (FIG. 2) of the container 16.

Similarly, to re-install the drain plug 126 upon completion of the fluid change-out operation and dispose the drain plug 126 in the locked position 28 (FIG. 3A), the operator or machine may insert the drain plug 126 along the central longitudinal axis 24 and rotate the drain plug 126 in the first direction 40 (FIG. 3A). As the plurality of threads 36 (FIG. 2) engage with and mate to the helical groove 38 (FIG. 2) and a distance between the locking element 48 and the drain plug 126 diminishes, the operator or machine may apply the force 68 against the elongated bar 70 and resilient member 50 along the central longitudinal axis 24 to depress the elongated bar 70 and resilient member 50 while concurrently aligning the elongated bar 70 with the recess 52. When the elongated bar 70 is aligned with the recess 52, the operator or machine may release the force 68 against the elongated bar 70 and resilient member 50 so that the elongated bar 70 may pop up or extend into the recess 52 and thereby mechanically interlock the drain plug 126 with the locking element 48. As such, the elongated bar 70 may protrude from the exterior surface 18 into the recess 52 so that the drain plug 126 is disposed in the locked position 28 (FIG. 3A) and is not rotatable about the central longitudinal axis 24. Consequently, fluid 14 (FIG. 2) may not drain from the interior cavity 20 (FIG. 2) of the container 16.

Referring now to FIGS. 4A-6B, in other embodiments, the locking element 148, 248, 348 may be attached to the drain plug 126. That is, for the embodiments described with respect to FIGS. 4A-6B, the locking element 148, 248, 348 is attached to the drain plug 126 rather than to the container 16.

Figure 4A:
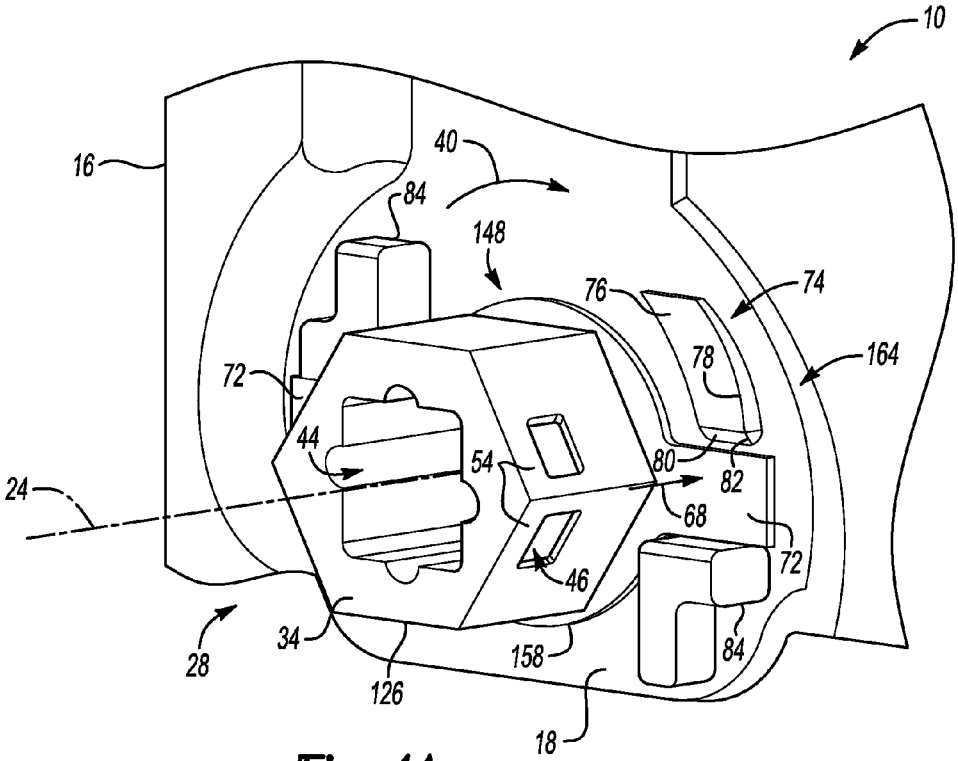
FIG. 4A is a schematic perspective fragmentary illustration of another embodiment of the drainable container system of FIGS. 1A and 1B, wherein the drain plug is disposed in the locked position.
Figure 4B:
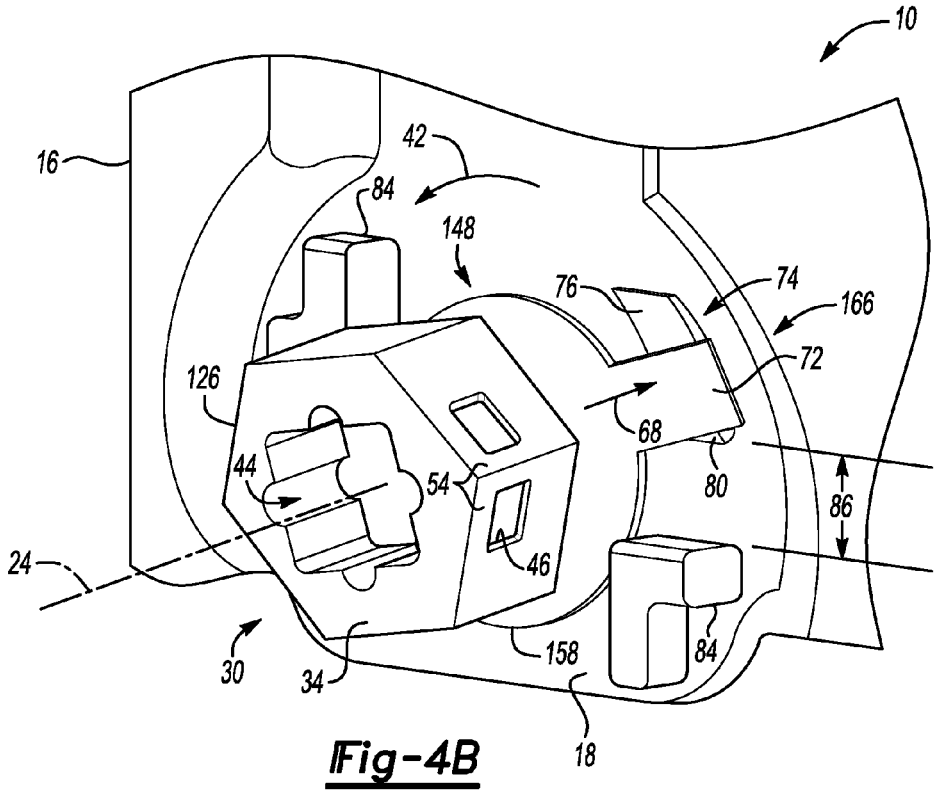
FIG. 4B is a schematic perspective fragmentary illustration of the drainable container system of FIG. 4A, wherein the drain plug is disposed in the unlocked position.

More specifically, as best shown in FIGS. 4A and 4B, in one embodiment, the locking element 148 may be configured as a disc 158 having at least one wing 72 extending therefrom. For example, as best shown in FIG. 4A, the disc 158 may have two wings 72 extend therefrom and spaced apart from one another. Further, as set forth above, the locking element 148 may be coaxial with the central longitudinal axis 24.

With continued reference to FIGS. 4A and 4B, in this embodiment, the drainable container system 10 further includes a retention ramp 74 protruding from the exterior surface 18 adjacent to the drain hole 22 (FIG. 3B). The retention ramp 74 has a first ramp surface 76 having a first slope 78 (FIG. 4A), and a second ramp surface 80 having a second slope 82 (FIG. 4A) that is larger than and opposite from the first slope 78. That is, the second ramp surface 80 may protrude from the exterior surface 18 at a comparatively sharper incline than the first ramp surface 76.

In addition, as best shown in FIG. 4A, in this embodiment, the drainable container system 10 further includes a stop 84 protruding from the exterior surface 18 and spaced opposite and apart from the retention ramp 74 to thereby define a gap 86 (FIG. 4B) between the retention ramp 74 and the stop 84. The gap 86 is configured for receiving the at least one wing 72 when the drain plug 126 is disposed in the locked position 28 (FIG. 4A).

As shown in FIG. 4A, for variations of the locking element 148 including two wings 72, it is to be appreciated that the drainable container system 10 may include two retention ramps 74 and two respective stops 84. Accordingly, each pair of retention ramps 74 and stops 84 may define a respective gap 86 therebetween, wherein each of the respective gaps 86 is configured for receiving one of the two wings 72.

In operation, as described with reference to FIGS. 4A and 4B, the at least one wing 72 may be translatable along the first ramp surface 76 as the drain plug 126 rotates within the drain hole 22 (FIG. 3B) in the first direction 40 (FIG. 4A) about the central longitudinal axis 24. The at least one wing 72 may be translatable until the at least one wing 72 abuts the stop 84 and is disposed within the gap 86 (FIG. 4B) to thereby prevent rotation of the drain plug 126 within the drain hole 22 in the second direction 42 (FIG. 4B) about the central longitudinal axis 24, and thereby dispose the drain plug 126 in the locked position 28 (FIG. 4A).

More specifically, during a fluid change-out operation, the drain plug 126 may be initially disposed in the locked position 28 (FIG. 4A). To dispose the drain plug 126 in the unlocked position 30 (FIG. 4B), first, the at least one wing 72 may be translatable away from the gap 86 along the second ramp surface 80 in response to the force (denoted generally by arrow 68 in FIGS. 4A and 4B) applied to the at least one wing 72 along the central longitudinal axis 24 as the drain plug 126 rotates within the drain hole 22 in the second direction 42 (FIG. 4B) about the central longitudinal axis 24. That is, to dispose the drain plug 126 in the unlocked position 30 (FIG. 4B), an operator or machine may apply the force 68 against the at least one wing 72 while concurrently turning the disc 158 in the second direction 42 so that the at least one wing 72 bumps into the retention ramp 74 and is resiliently nudged out of an original plane, i.e., a plane parallel to the exterior surface 18 of the container 16, to translate upwards along the second ramp surface 80. Stated differently, concurrent to applying the force 68, the operator or machine may rotate the drain plug 126 in the second direction 42 (FIG. 4B), e.g., counterclockwise, so as to dislodge or displace the at least one wing 72 from the gap 86 (FIG. 4B) so that the at least one wing 72 translates first along the second ramp surface 80, and subsequently along the first ramp surface 76, to thereby dispose the drain plug 126 in the unlocked position 30 (FIG. 4B) for removal of the drain plug 126 from the drain hole 22 along the central longitudinal axis 24.

With continued reference to FIGS. 4A and 4B, after the at least one wing 72 translates along the first ramp surface 76, the at least one wing 72 may then again be resiliently aligned within the original plane, i.e., the plane parallel to the exterior surface 18 of the container 16, and therefore translate along the exterior surface 18 of the container 16. The operator or machine may then continue rotating the locking element 148 attached to the drain plug 126 in the second direction 42 so as to disengage the plurality of threads 36 (FIG. 2) from the helical groove 38 (FIG. 2) and thereby remove the drain plug 126 from the drain hole 22 along the central longitudinal axis 24. Consequently, fluid 14 (FIG. 2) may drain from the interior cavity 20 (FIG. 2) of the container 16.

Similarly, to re-install the drain plug 126 upon completion of the fluid change-out operation and dispose the drain plug 126 in the locked position 28 (FIG. 4A), the operator or machine may insert the drain plug 126 along the central longitudinal axis 24 and rotate the drain plug 126 in the first direction 40 (FIG. 4A). As the plurality of threads 36 (FIG. 2) engage with and mate to the helical groove 38 (FIG. 2) and a distance between the locking element 148 and the drain plug 126 diminishes, the operator or machine may apply the force 68 against the at least one wing 72 along the central longitudinal axis 24 while concurrently turning the disc 158 in the first direction 40 so that the at least one wing 72 bumps into the retention ramp 74 and is resiliently nudged out of the original plane so as to translate upwards along the first ramp surface 76. Stated differently, concurrent to applying the force 68, the operator or machine may rotate the drain plug 126 in the first direction 40, e.g., clockwise, so as to translate the at least one wing 72 first along the first ramp surface 76, and subsequently along the second ramp surface 80 to dispose the at least one wing 72 within the gap 86. As such, the gap 86 may receive the at least one wing 72 so that the drain plug 126 is disposed in the locked position 28 and is not rotatable about the central longitudinal axis 24. Consequently, fluid 14 (FIG. 2) may not drain from the interior cavity 20 (FIG. 2) of the container 16.

Figure 5A:
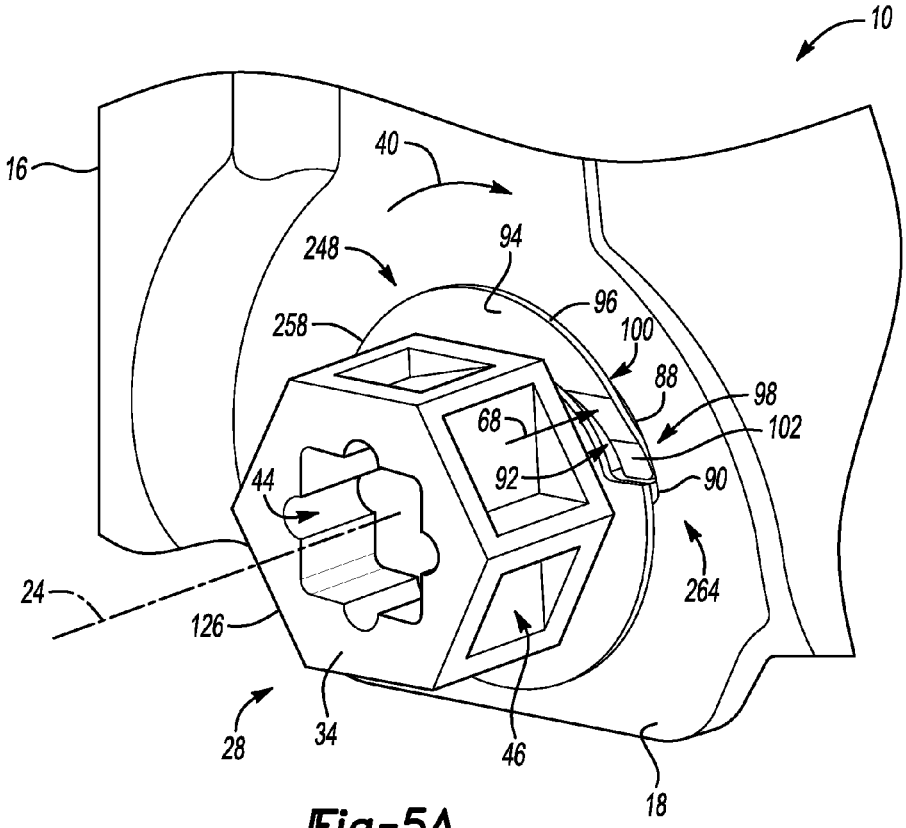
FIG. 5A is a schematic perspective fragmentary illustration of another embodiment of the drainable container system of FIGS. 1A and 1B, wherein the drain plug is disposed in the locked position.
Figure 5B:
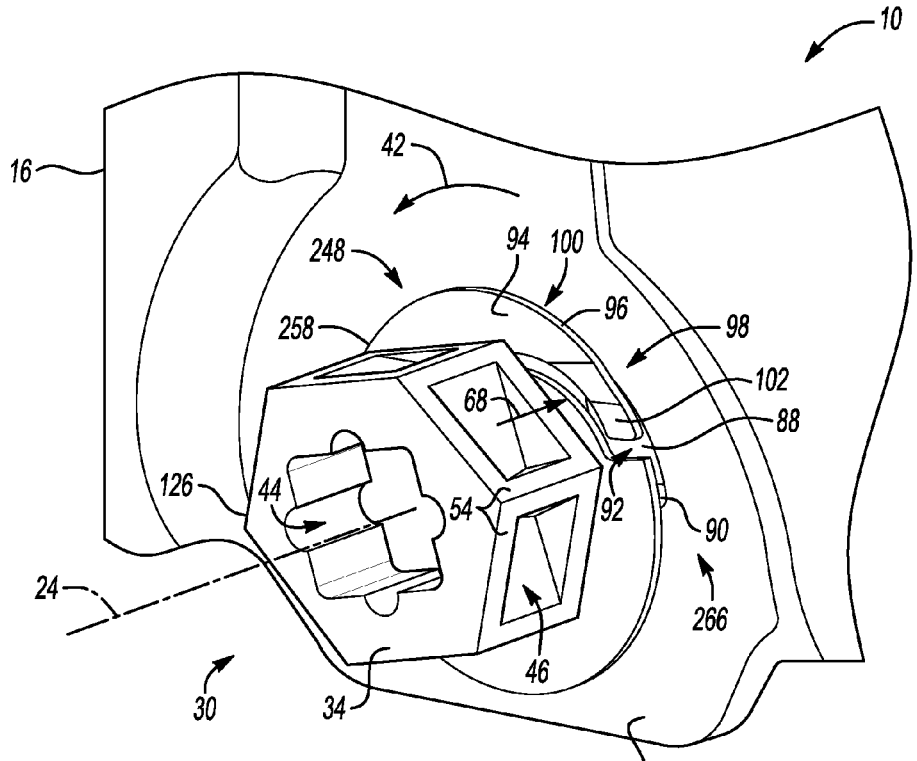
FIG. 5B is a schematic perspective fragmentary illustration of the drainable container system of FIG. 5A, wherein the drain plug is disposed in the unlocked position.

Referring now to FIGS. 5A and 5B, in another embodiment, the exterior surface 18 has an incline portion 88 and a notch portion 90 spaced apart from the incline portion 88. Each of the incline portion 88 and the notch portion 90 protrudes into the interior cavity 20 (FIG. 2) to define a retention trough 92 in the exterior surface 18. That is, the exterior surface 18 defines the retention trough 92 as an indented channel therein.

As shown in FIGS. 5A and 5B, in this embodiment, the locking element 248 may also be configured as a disc 258 that is coaxial with the central longitudinal axis 24. The disc 258 has an engagement surface 94 disposed substantially perpendicular to the central longitudinal axis 24, and an outer edge surface 96 disposed substantially parallel to the central longitudinal axis 24. That is, the outer edge surface 96 may abut and be disposed substantially perpendicular to the engagement surface 94 of the locking element 248. Further, the locking element 248 may have a resilient finger portion 98 formed along a section 100 of the outer edge surface 96, and the resilient finger portion 98 may have a distal end 102.

With continued reference to FIGS. 5A and 5B, in operation, the resilient finger portion 98 may be transitionable between a first position 264 (FIG. 5A) in which the distal end 102 extends into the retention trough 92 and abuts the notch portion 90 so that the drain plug 126 is disposed in the locked position 28 (FIG. 5A) and is not rotatable about the central longitudinal axis 24, and a second position 266 (FIG. 5B) in which the distal end 102 is substantially flush with the engagement surface 94 so that the drain plug 126 is disposed in the unlocked position 30 (FIG. 5B) and is rotatable about the central longitudinal axis 24.

In particular, to dispose the drain plug 126 in the locked position 28 (FIG. 5A), the resilient finger portion 98 may be translatable along the incline portion 88 towards the notch portion 90 as the drain plug 126 rotates within the drain hole 22 (FIG. 3B) in the first direction 40 (FIG. 5A) about the central longitudinal axis 24. The resilient finger portion 98 may be translatable until the distal end 102 abuts the notch portion 90 and is disposed within the retention trough 92 to thereby prevent rotation of the drain plug 126 within the drain hole 22 in the second direction 42 (FIG. 5B) about the central longitudinal axis 24, and thereby dispose the drain plug 126 in the locked position 28 (FIG. 5A).

Conversely, the resilient finger portion 98 may be translatable out of the retention trough 92 away from the notch portion 90 along the incline portion 88 in response to the force 68 (FIGS. 5A and 5B) applied to the engagement surface 94 and the resilient finger portion 98 along the central longitudinal axis 24 as the drain plug 126 rotates within the drain hole 22 (FIG. 3B) in the second direction 42 (FIG. 5B) about the central longitudinal axis 24.

More specifically, during a fluid change-out operation, the drain plug 126 may be initially disposed in the locked position 28 (FIG. 5A). To dispose the drain plug 126 in the unlocked position 30 (FIG. 5B), an operator or machine may apply the force 68 against the engagement surface 94 and the resilient finger portion 98 while concurrently turning the disc 258 in the second direction 42 so that the distal end 102 translates away from the notch portion 90 and along the incline portion 88. The distal end 102 is therefore resiliently nudged out of an original plane, i.e., a plane extending into the interior cavity 20 (FIG. 2) of the container 16, so as to translate upwards along the incline portion 88. Stated differently, concurrent to applying the force 68, the operator or machine may rotate the drain plug 126 in the second direction 42 (FIG. 5B), e.g., counterclockwise, to dislodge or displace the resilient finger portion 98 from the retention trough 92 so that the resilient finger portion 98 translates away from the notch portion 90 along the incline portion 88, to thereby dispose the drain plug 126 in the unlocked position 30 for removal of the drain plug 126 from the drain hole 22 along the central longitudinal axis 24.

With continued reference to FIGS. 5A and 5B, after the resilient finger portion 98 translates along the incline portion 88, the resilient finger portion 98 may then be resiliently aligned with the engagement surface 94 of the locking element 248 so that the distal end 102 may translate along the exterior surface 18 of the container 16. The operator or machine may then continue rotating the locking element 248 attached to the drain plug 126 in the second direction 42 to disengage the plurality of threads 36 (FIG. 2) from the helical groove 38 (FIG. 2) and thereby remove the drain plug 126 from the drain hole 22 along the central longitudinal axis 24. Consequently, fluid 14 may drain from the interior cavity 20 of the container 16.

Similarly, to re-install the drain plug 126 upon completion of the fluid change-out operation and dispose the drain plug 126 in the locked position 28 (FIG. 5A), the operator or machine may insert the drain plug 126 along the central longitudinal axis 24 and rotate the drain plug 126 in the first direction 40 (FIG. 5A). As the plurality of threads 36 (FIG. 2) engage with and mate to the helical groove 38 (FIG. 2) and a distance between the locking element 248 and the drain plug 126 diminishes, the operator or machine may apply the force 68 against the engagement surface 94 and resilient finger portion 98 along the central longitudinal axis 24 while concurrently turning the disc 258 in the first direction 40 so that the resilient finger portion 98 slides into the retention trough 92 until the distal end 102 abuts the notch portion 90. Stated differently, concurrent to applying the force 68, the operator or machine may rotate the drain plug 126 in the first direction 40 (FIG. 5A), e.g., clockwise, to translate the distal end 102 along the incline portion 88 towards the notch portion 90. As such, the retention trough 92 may receive the resilient finger portion 98 so that the drain plug 126 is disposed in the locked position 28 and is not rotatable about the central longitudinal axis 24. Consequently, fluid 14 (FIG. 2) may not drain from the interior cavity 20 (FIG. 2) of the container 16.

Figure 6A:
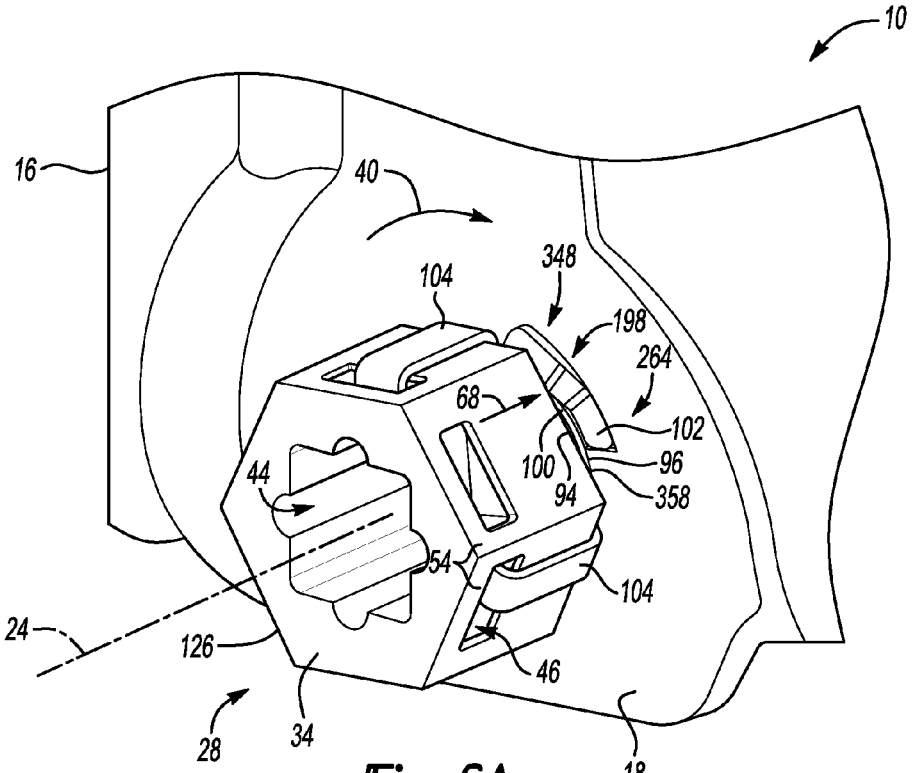
FIG. 6A is a schematic perspective fragmentary illustration of another embodiment of the drainable container system of FIGS. 1A and 1B, wherein the drain plug is disposed in the locked position.
Figure 6B:
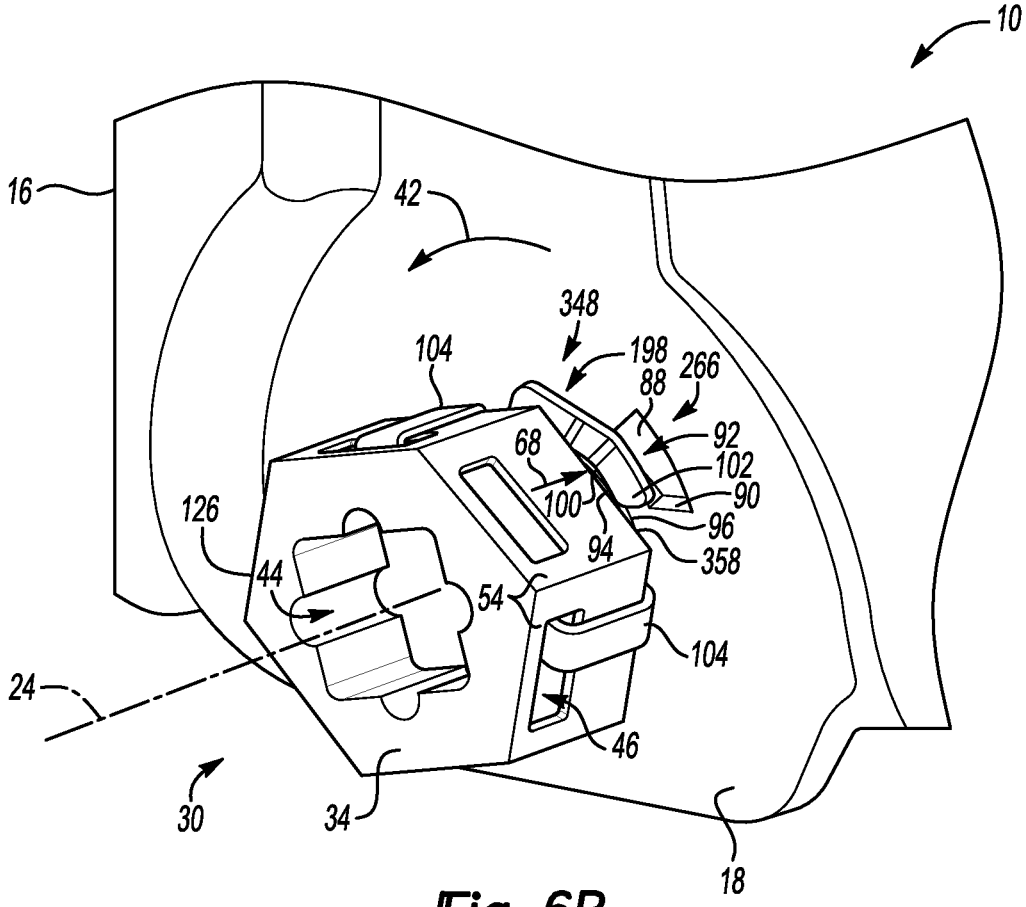
FIG. 6B is a schematic perspective fragmentary illustration of the drainable container system of FIG. 6A, wherein the drain plug is disposed in the unlocked position.

Referring now to FIGS. 6A and 6B, in another embodiment, the resilient finger portion 198 may adjoin and extend from the section 100 of the outer edge surface 96. That is, for this embodiment, the disc 358 may be smaller in diameter than the disc 258 of the embodiment shown in FIGS. 5A and 5B, and the resilient finger portion 198 may extend from the outer edge surface 96 and terminate at the distal end 102. In addition, in this embodiment, the locking element 348 may include a plurality of fasteners 104. Each of the plurality of fasteners 104 may extend from the disc 358 and be configured for attaching the locking element 348 to the drain plug 126. The plurality of fasteners 104 may attach the drain plug 126 to the locking element 348 in any manner. In one non-limiting example, as shown in FIGS. 6A and 6B, each of the plurality of fasteners 104 may attach to the head 34 of the drain plug 126, e.g., may each fasten to the aperture 46 defined by the head 34.

With continued reference to FIGS. 6A and 6B, in operation, the resilient finger portion 198 may be transitionable between a first position 264 (FIG. 6A) in which the distal end 102 extends into the retention trough 92 and abuts the notch portion 90 so that the drain plug 126 is disposed in the locked position 28 (FIG. 6A) and is not rotatable about the central longitudinal axis 24, and a second position 266 (FIG. 6B) in which the distal end 102 is substantially flush with the engagement surface 94 so that the drain plug 126 is disposed in the unlocked position 30 (FIG. 6B) and is rotatable about the central longitudinal axis 24.

In particular, to dispose the drain plug 126 in the locked position 28 (FIG. 6A), the resilient finger portion 198 may be translatable along the incline portion 88 towards the notch portion 90 as the drain plug 126 rotates within the drain hole 22 (FIG. 3B) in the first direction 40 (FIG. 6A) about the central longitudinal axis 24. The resilient finger portion 198 may be translatable until the distal end 102 abuts the notch portion 90 and is disposed within the retention trough 92 to thereby prevent rotation of the drain plug 126 within the drain hole 22 in the second direction 42 (FIG. 6B) about the central longitudinal axis 24, and thereby dispose the drain plug 126 in the locked position 28 (FIG. 6A).

Conversely, the resilient finger portion 198 may be translatable out of the retention trough 92 away from the notch portion 90 along the incline portion 88 in response to the force 68 (FIGS. 6A and 6B) applied to the engagement surface 94 and the resilient finger portion 198 along the central longitudinal axis 24 as the drain plug 126 rotates within the drain hole 22 (FIG. 3B) in the second direction 42 (FIG. 6B) about the central longitudinal axis 24.

More specifically, during a fluid change-out operation, the drain plug 126 may be initially disposed in the locked position 28 (FIG. 6A). To dispose the drain plug 126 in the unlocked position 30 (FIG. 6B), an operator or machine may apply the force 68 against the engagement surface 94 and the resilient finger portion 198 while concurrently turning the disc 358 in the second direction 42 so that the distal end 102 translates away from the notch portion 90 and along the incline portion 88. The distal end 102 is therefore resiliently nudged out of an original plane, i.e., a plane extending into the interior cavity 20 (FIG. 2) of the container 16, so as to translate upwards along the incline portion 88. Stated differently, concurrent to applying the force 68, the operator or machine may rotate the drain plug 126 in the second direction 42 (FIG. 6B), e.g., counterclockwise, to dislodge or displace the resilient finger portion 198 from the retention trough 92 so that the resilient finger portion 198 translates away from the notch portion 90 along the incline portion 88, to thereby dispose the drain plug 126 in the unlocked position 30 for removal of the drain plug 126 from the drain hole 22 along the central longitudinal axis 24.

With continued reference to FIGS. 6A and 6B, after the resilient finger portion 198 translates along the incline portion 88, the resilient finger portion 198 may then be resiliently aligned with the engagement surface 94 of the locking element 348 so that the distal end 102 may translate along the exterior surface 18 of the container 16. The operator or machine may then continue rotating the locking element 348 attached to the drain plug 126 in the second direction 42 to disengage the plurality of threads 36 (FIG. 2) from the helical groove 38 (FIG. 2) and thereby remove the drain plug 126 from the drain hole 22 along the central longitudinal axis 24. Consequently, fluid 14 may drain from the interior cavity 20 of the container 16.

Similarly, to re-install the drain plug 126 upon completion of the fluid change-out operation and dispose the drain plug 126 in the locked position 28 (FIG. 6A), the operator or machine may insert the drain plug 126 along the central longitudinal axis 24 and rotate the drain plug 126 in the first direction 40 (FIG. 6A). As the plurality of threads 36 (FIG. 2) engage with and mate to the helical groove 38 (FIG. 2) and a distance between the locking element 348 and the drain plug 126 diminishes, the operator or machine may apply the force 68 against the engagement surface 94 and resilient finger portion 198 along the central longitudinal axis 24 while concurrently turning the disc 358 in the first direction 40 so that the resilient finger portion 198 slides into the retention trough 92 until the distal end 102 abuts the notch portion 90. Stated differently, concurrent to applying the force 68, the operator or machine may rotate the drain plug 126 in the first direction 40 (FIG. 6A), e.g., clockwise, to translate the distal end 102 along the incline portion 88 towards the notch portion 90. As such, the retention trough 92 may receive the resilient finger portion 198 so that the drain plug 126 is disposed in the locked position 28 and is not rotatable about the central longitudinal axis 24. Consequently, fluid 14 (FIG. 2) may not drain from the interior cavity 20 (FIG. 2) of the container 16.

As such, for each of the aforementioned embodiments, the drain plug 126 may be translatable from the locked position 28 to the unlocked position 30 in response to the force 68 applied to the locking element 48, 148, 248, 348 along the central longitudinal axis 24 as the drain plug 126 rotates about the central longitudinal axis 24.

Referring again to FIG. 2, the drainable container system 10 may also include a seal 106 configured to further block ingress of contaminants to, and/or egress of fluid 14 from, the interior cavity 20. The seal 106 may be configured as, for example, an O-ring or washer, and may be formed from an elastomer compatible with the fluid 14.

Accordingly, the drainable container system 10 allows for fluid change-out operations that occur at a temperature of from about −40° C. to about 10° C. That is, the drain plug 26, 126 of the drainable container system 10 may be unfastened and removed from the drain hole 22 in extremely cold operating conditions without breaking due to fatigue or brittleness. Rather, the drain plug 26, 126 seals the drain hole 22, locks into position by way of the locking element 48, 148, 248, 348, and is easily removed from the drain hole 22 for fluid change-out operations under cold weather conditions. Since the locking element 48, 148, 248, 348 is formed from a substantially elastic, e.g., non-brittle, metal, the locking element 48, 148, 248, 348 does not suffer from brittle failure and/or fatigue failure upon repeated insertion into and removal from the drain hole 22. Further, the locking element 48, 148, 248, 348 prevents rotation of the drain plug 26, 126 within the drain hole 22 and therefore minimizes loosening or unintended removal of the drain plug 26, 126 during operation of the vehicle 12, i.e., after installation. In addition, the locking element 48, 148, 248, 348 allows the drain plug 26, 126 to be fastened to the container 16 with a socket wrench for ease of installation and assembly.

While the best modes for carrying out the disclosure have been described in detail, those familiar with the art to which this disclosure relates will recognize various alternative designs and embodiments for practicing the disclosure within the scope of the appended claims.

The invention claimed is:

1. A drainable container system for a vehicle, the drainable container system comprising:

a container having an exterior surface and defining;

an interior cavity configured for storing a fluid; and a drain hole configured for draining the fluid from the interior cavity, wherein the drain hole has a central longitudinal axis that is substantially perpendicular to the exterior surface;

a drain plug;

wherein the drain plug is insertable into the drain hole along the central longitudinal axis into a locked position so that the fluid does not drain from the interior cavity; and wherein the drain plug is removable from the drain hole along the central longitudinal axis when disposed in an unlocked position so that the fluid drains from the interior cavity; and a locking element attached to the container and configured for preventing rotation of the drain plug within the drain hole about the central longitudinal axis when the drain plug is disposed in the locked position, wherein the locking element is formed from a metal that is substantially elastic at a temperature of from about −40° C. to about 10° C.;

wherein the drain plug is configured for mechanically interlocking with the locking element, and defines a recess therein;

wherein the locking element includes a depressible tab configured for extending into the recess so that the locking element mechanically interlocks with the drain plug and thereby prevents rotation of the drain plug within the drain hole about the central longitudinal axis when the drain plug is disposed in the locked position;

wherein the locking element is configured as a disc having an outer surface, and is coaxial with the central longitudinal axis; and further wherein the depressible tab is configured as a resilient clip that is transitionable between;

a first position in which the resilient clip protrudes from the outer surface into the recess so that the drain plug is disposed in the locked position and is not rotatable about the central longitudinal axis; and a second position in which the resilient clip is substantially flush with the outer surface and does not protrude into the recess so that the drain plug is disposed in the unlocked position and is rotatable about the central longitudinal axis.

2. The drainable container system of claim 1, wherein the resilient clip is transitionable from the first position to the second position in response to a force applied to the resilient clip along the central longitudinal axis.

3. A drainable container system for a vehicle, the drainable container system comprising:

a container having an exterior surface and defining;

an interior cavity configured for storing a fluid; and a drain hole configured for draining the fluid from the interior cavity, wherein the drain hole has a central longitudinal axis that is substantially perpendicular to the exterior surface;

a drain plug;

wherein the drain plug is insertable into the drain hole along the central longitudinal axis into a locked position so that the fluid does not drain from the interior cavity; and wherein the drain plug is removable from the drain hole along the central longitudinal axis when disposed in an unlocked position so that the fluid drains from the interior cavity; and a locking element attached to the container and configured for preventing rotation of the drain plug within the drain hole about the central longitudinal axis when the drain plug is disposed in the locked position, wherein the locking element is formed from a metal that is substantially elastic at a temperature of from about −40° C. to about 10° C.;

wherein the drain plug is configured for mechanically interlocking with the locking element, and defines a recess therein;

wherein the locking element includes:

a depressible tab configured for extending into the recess so that the locking element mechanically interlocks with the drain plug and thereby prevents rotation of the drain plug within the drain hole about the central longitudinal axis when the drain plug is disposed in the locked position; and a resilient member;

wherein the depressible tab is configured as an elongated bar that is actuatable by the resilient member; and further wherein the elongated bar is transitionable between;

a first position in which the elongated bar protrudes from the container adjacent to the drain hole and into the recess so that the drain plug is disposed in the locked position and is not rotatable about the central longitudinal axis; and a second position in which the elongated bar is substantially flush with the exterior surface and does not protrude into the recess so that the drain plug is disposed in the unlocked position and is rotatable about the central longitudinal axis.

4. The drainable container system of claim 3, wherein the elongated bar is transitionable from the first position to the second position in response to a force applied to the elongated bar and the resilient member along the central longitudinal axis.

5. A drainable container system for a vehicle, the drainable container system comprising:

a container having an exterior surface and defining;

an interior cavity configured for storing a fluid;

a drain hole configured for draining the fluid from the interior cavity, wherein the drain hole has a central longitudinal axis that is substantially perpendicular to the exterior surface;

a drain plug;

wherein the drain plug is insertable into the drain hole along the central longitudinal axis into a locked position so that the fluid does not drain from the interior cavity; and wherein the drain plug is removable from the drain hole along the central longitudinal axis when disposed in an unlocked position so that the fluid drains from the interior cavity; and a locking element attached to the drain plug and configured for preventing rotation of the drain plug within the drain hole about the central longitudinal axis when the drain plug is disposed in the locked position, wherein the locking element is formed from a metal that is substantially elastic at a temperature of from about −40° C. to about 10° C.;

wherein the exterior surface has an incline portion and a notch portion spaced apart from the incline portion, and further wherein each of the incline portion and the notch portion protrudes into the interior cavity to define a retention trough in the exterior surface;

wherein the locking element is configured as a disc that is coaxial with the central longitudinal axis and has;

an engagement surface disposed substantially perpendicular to the central longitudinal axis;

an outer edge surface disposed substantially parallel to the central longitudinal axis; and a resilient finger portion formed along a section of the outer edge surface and having a distal end; and further wherein the resilient finger portion is transitionable between;

a first position in which the distal end extends into the retention trough and abuts the notch portion so that the drain plug is disposed in the locked position and is not rotatable about the central longitudinal axis; and a second position in which the distal end is substantially flush with the engagement surface so that the drain plug is disposed in the unlocked position and is rotatable about the central longitudinal axis.

6. The drainable container system of claim 5, wherein the resilient finger portion is translatable along the incline portion towards the notch portion as the drain plug rotates within the drain hole in a first direction about the central longitudinal axis until the distal end abuts the notch portion and is disposed within the retention trough to thereby prevent rotation of the drain plug within the drain hole in a second direction that is opposite the first direction about the central longitudinal axis, and thereby dispose the drain plug in the locked position.

7. The drainable container system of claim 6, wherein the resilient finger portion is translatable out of the retention trough away from the notch portion along the incline portion in response to a force applied to the engagement surface and the resilient finger portion along the central longitudinal axis as the drain plug rotates within the drain hole in the second direction about the central longitudinal axis.

8. The drainable container system of claim 7, wherein the resilient finger portion adjoins and extends from the section of the outer edge surface.

9. The drainable container system of claim 8, wherein the locking element includes a plurality of fasteners each extending from the disc and configured for attaching the locking element to the drain plug.

* * * * *